United States Patent [19]

Lyles

[11] 4,181,119

[45] Jan. 1, 1980

[54] COMBINED CHIMNEY COVER AND DAMPER

[76] Inventor: Herbert H. Lyles, 153 McAlway Rd., Charlotte, N.C. 28211

[21] Appl. No.: 883,384

[22] Filed: Mar. 6, 1978

[51] Int. Cl.[2] ..... F23L 3/00

[52] U.S. Cl. ..... 126/286; 126/285 R; 98/59

[58] Field of Search ..... 126/285 A, 286; 98/59, 98/60

[56] References Cited

U.S. PATENT DOCUMENTS

| | | | |
|---|---|---|---|
| 2,148,713 | 2/1939 | Roof | 126/285 A |
| 2,311,915 | 2/1943 | Tummel | 98/59 |
| 2,704,502 | 3/1955 | Rainey | 98/59 |
| 3,267,832 | 8/1966 | Hinkle | 98/59 |
| 3,570,423 | 3/1971 | Hemmingson | 98/60 |

*Primary Examiner*—Samuel Scott

*Assistant Examiner*—Wesley S. Ratliff, Jr.

*Attorney, Agent, or Firm*—Clifton T. Hunt, Jr.

[57] ABSTRACT

A combined chimney cover and damper comprising an elongated sleeve having a closed end defining the cover and an open end supported within the chimney, support means extending laterally from the sleeve and engageable with the top of the chimney to support and maintain the cover and damper in operative relation to the chimney, at least one aperture in the sleeve between the support means and the closed end of the sleeve, a damper normally resiliently urged upwardly within the sleeve against its closed end to cover the aperture, and means for moving the damper across the aperture to establish communication between the interior of the chimney and the atmosphere. The cover preferably includes a flange spaced horizontally outwardly from and at least partially overlapping the aperture to protect it against wind blown rain and snow.

8 Claims, 6 Drawing Figures

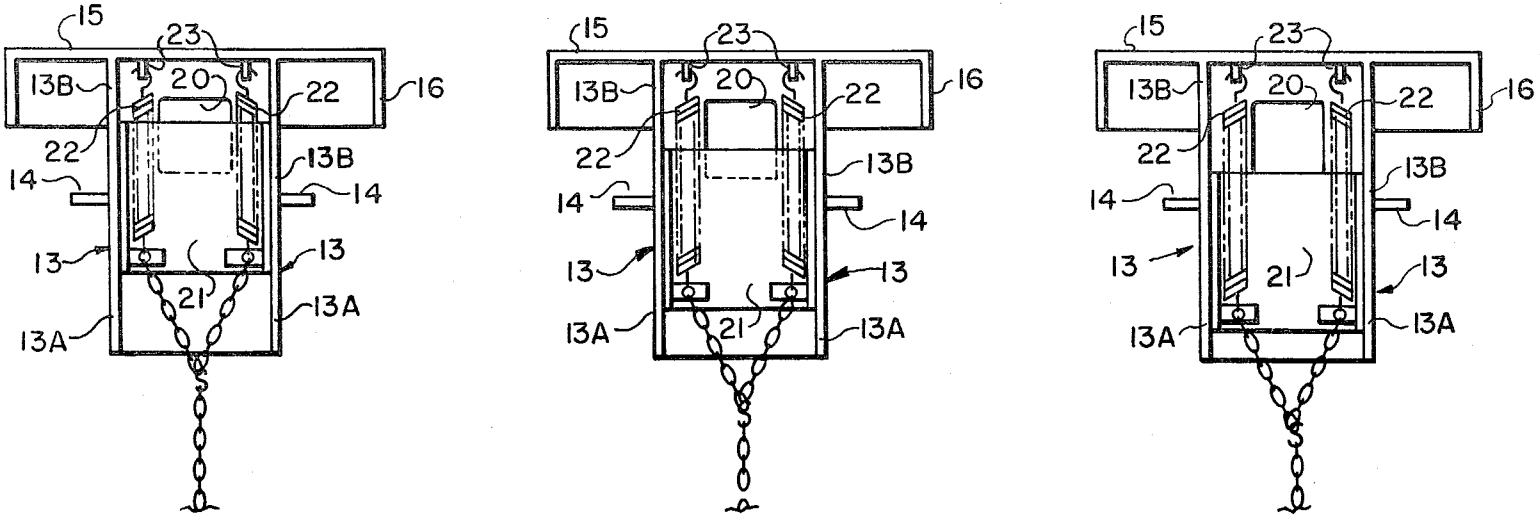
FIG. 3
FIG. 4
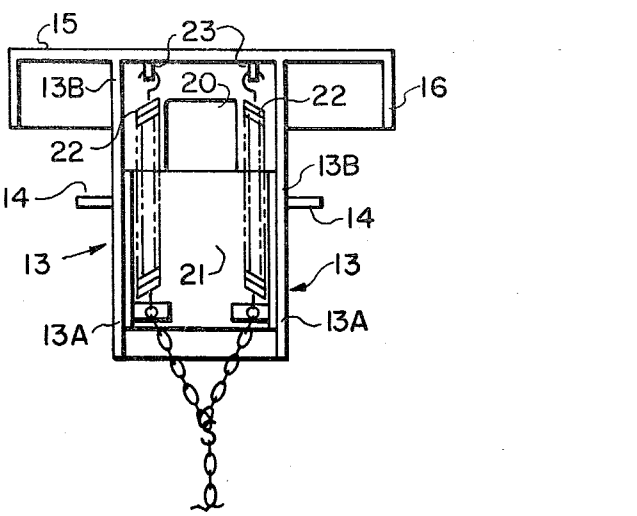
FIG. 5
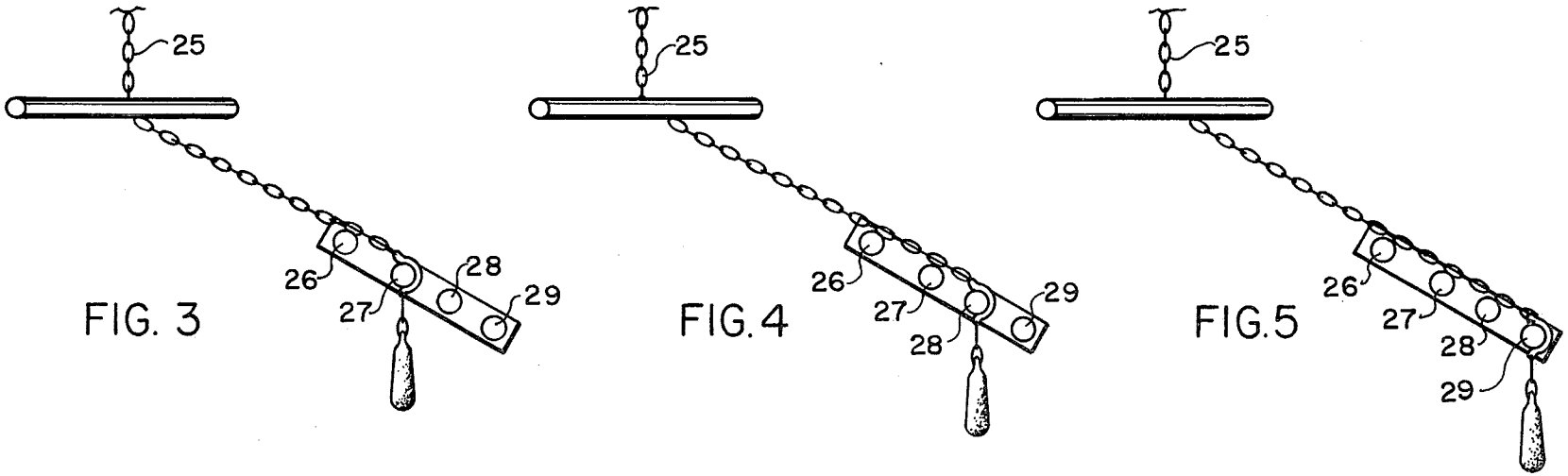

COMBINED CHIMNEY COVER AND DAMPER

BACKGROUND OF THE INVENTION

The invention is particularly intended for use with chimneys of fireplaces. It is well known that chimneys are responsible for the loss of heat from a house when the fireplace is not being used. A vacuum is created when wind currents blow across the top of the chimney and the damper is located in the dome of the fireplace thereby drawing heat from the house into the chimney. It is well known, too, that animals and birds sometimes enter houses through the tops of chimneys.

There have been attempts to effectively deal with these problems by locatin a remotely controlled damper at the top of the chimney, and in some prior attempts the damper serves as a cover for the chimney. See for example, U.S. Pat. No. 4,007,730 to Frederick Heeblink, U.S. Pat. No. 3,267,832 to Charles G. Hinkle, U.S. Pat. No. 12,404 issued Feb. 20, 1855 to George B. Clark, U.S. Pat. No. 3,945,307 issued Mar. 23, 1976 to Bentford C. Lyemance, and U.S. Pat. No. 4,020,754 issued May 3, 1977 to Bernard L. Dalsin et al. In each of the foregoing patents the chimeny is accessible to entry by birds and animals when the damper is open. Some of the prior attempts to provide an efficient damper and cover at the top of a chimney require the services of a mechanic to install it and some of them employ complex linkage to operate the damper after it is installed. Another disadvantage of some of the prior attempts is that they permit wind blown rain to enter the chimney when the damper is open.

SUMMARY OF THE INVENTION

The combined cover and damper of the present invention can be readily installed on a chimney by the average home owner without the services of a mechanic, and when installed is effective to prevent loss of heat and entry of birds and animals.

Chimney flues are generally one of three standard sizes and the present invention will be made in appropriate sizes to conform with the conventional chimney sizes. An elongated sleeve made from sheet metal is dimensioned to fit snugly within a chimney flue and to extend into the flue about one or two feet (5 to 10 centimeters). The upper end of the sleeve is closed and flanges extend outwardly from the sleeve and rest on the chimney top to support the closed end in spaced relation to the top of the chimney. The closed top of the sleeve is about one or two feet (5 to 10 centimeters) above the top of the chimney, and the upper exposed portion of the sleeve above the chimney has one or more apertures (preferably four) to provide communication between the atmosphere and the interior of the sleeve and the chimney therebeneath.

The apertures in the sleeve are normally closed by a damper slidably mounted within the sleeve and resiliently retained against the lower surface of the cover. A chain extends from the damper to the hearth and when the chain is tensioned the resilient mounting of the damper to the cover is overcome and the damper is moved downwardly within the sleeve beneath the apertures in the sleeve to establish communication between the atmosphere and the interior of the chimney. A peripheral flange extends around the cover in spaced at least partially overlying relation to the apertures in the sleeve to protect the apertures against wind blown snow and rain when the damper is in operative position.

BRIEF DESCRIPTION OF THE DRAWINGS

FIGS. 3, 4 and 5 are each somewhat schematic vertical sectional views of the damper and cover assembly removed from the chimney and illustrating the varying sizes of openings obtainable by manipulation of the damper.

DETAILED DESCRIPTION OF THE INVENTION

Figure 1:
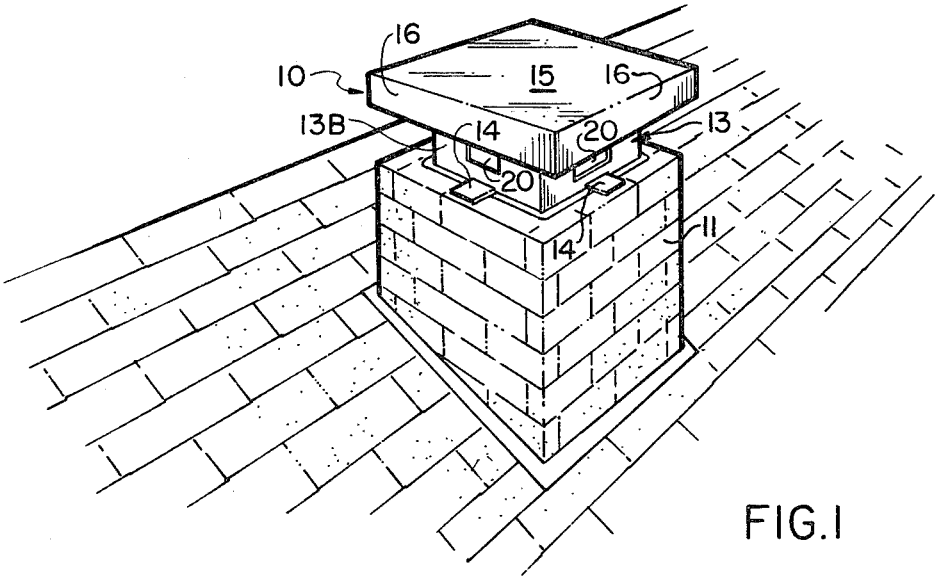
FIG. 1 is a perspective view of the combined cover and damper mounted on top of a chimney.

Referring more specifically to the drawings, the numeral 10 broadly indicates a combined chimney cover and damper assembly mounted on a conventional chimney 11. Chimneys are conventionally provided with flue liners and the flue liners are generally one of three standard sizes, 8 by 11, 10 by 12 and 14 by 16. A conventional flue liner of a desired size is indicated at 12 in the drawings.

Figure 2:
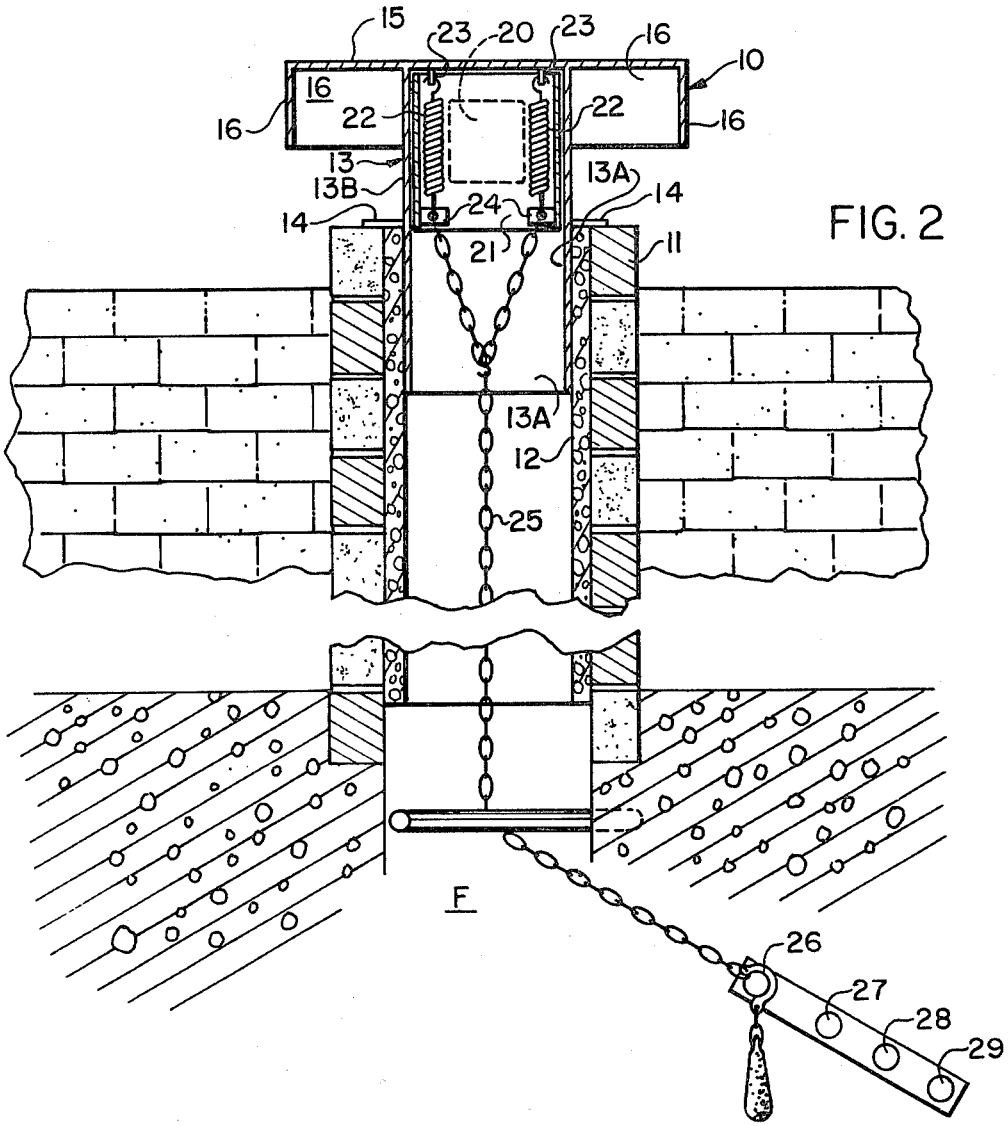
FIG. 2 is a vertical sectional view taken substantially along the line 2—2 in FIG. 1, and also showing the dome of the fireplace beneath the chimney.
Figure 2A:
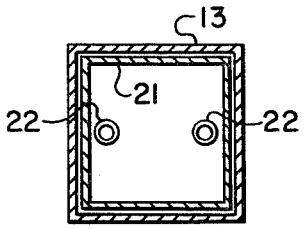
FIG. 2A is a horizontal sectional view taken through the chimney cover and damper above the chimney in FIG. 1.

The combined chimney cover and damper assembly 10 includes an elongated sleeve 13 preferably made of sheet metal or other desired non-combustible material and dimensioned to fit snugly within the flue liner 12 as most clearly seen in FIG. 2. The illustrated sleeve has four sides joined as by welding at their adjoining longitudinal edges. The lower portion 13A of sleeve 13 is slidably received within flue 12, a sufficient distance to cause the sides of the sleeve to bear against the chimney and retain the sleeve within the chimney against lateral pressure against the exposed portion 13B of the sleeve as by wind or animals. A flange 14 projects laterally from each side wall of sleeve 13 at about the axial midpoint of sleeve 13. The flanges 14 are adapted to rest on top of the flue liner 12 and its associated chimney 11 as most clearly seen in FIG. 2, thereby supporting the combination chimney and damper securely on the chimney without the need of further fastening.

The sleeve 13 extends upwardly above the flanges or other suitable support means 14 as indicated at 13B in the drawings, and is joined at its upper edges to a horizontally extending cover 15. Cover 15 is suitably secured, as by welding, to all four sides of sleeve 13 and extends laterally beyond the sides of sleeve 13 a distance approximately equal to one-half of the laterial dimension of the sleeve. A downturned flange 16 extends circumferentially around cover 15. The flange 16 extends vertically downwardly from the edges of cover 15 a desired distance to prevent windblown rain from entering the chimney when the damper is opened, a distance of six to twelve inches (0.25 to 0.5 millimeters) being found suitable for this purpose.

The upper portion 13B of sleeve 13 has a cut-out or aperture 20 in each of the walls of the sleeve through which smoke passes from the chimney in normal operation. The apertures 20 are selectively closable by manipulation of a vertically slidable inner sleeve or damper 21. Inner sleeve 21 is supported from the lower surface of cover 15 by springs 22 connected to hooks 23 depending from the inner surface of cover 15 overlying the flue liner 12 of chimney 11. The springs 22 are substantially coextensive with the length of inner sleeve or damper 21 and the lower ends of springs 22 are connected to lugs or brackets 24 adjacent the lower edge of inner sleeve 21.

The springs 22 urge the damper 22 upwardly toward cover 15, and damper 21 in abutting relation to the inner surface of cover 15, as shown in FIG. 2.

A chain 25 is connected to brackets 24 and extends downwardly therefrom through the flue liner 12 to the fireplace F therebeneath and around guide bar 30 to one of a plurality of pins 26, 27, 28 or 29 as desired on adjusting plate 31 to open or close the apertures 20. As shown in FIG. 2, chain 25 is connected to pin 26 which permits the springs 22 to retract and move the inner sleeve 21 into abutting relation with the cover 15 to close the openings 22 when there is no fire in the fireplace.

A chain 25 may be moved to pins 27, 28 or 29 to selectively open the apertures 20 a small amount (pin 27), a medium amount (pin 28), or the maximum amount (pin 29) as illustrated in FIGS. 3, 4 and 5.

In use, the apertures 20 are closed when there is not a fire in the fireplace by moving the chain 25 to the pin 26, allowing the springs to retract and move the upper edge of inner sleeve 21 into engagement with the lower surface of cover 15. When a fire is started, the damper is opened the maximum amount by moving the chain to pin 29 (FIG. 5). This provides a maximum draft through the chimney which facilitates starting of the fire. After the fire has started and is burning satisfactorily, the damper is desirably partially closed to the position of FIG. 3 or 4. The partially opened damper reduces the draft in the chimney and consequently reduces the amount of house heat that passes through the chimney and reduces the amount of fuel consumed. Fuel consumption decreases with a decrease in the draft passing through the chimney. It is difficult to adjust the damper to control the draft when the damper is located in the dome of the fireplace and the fire is burning because of the danger of being burned. Location of the adjusting plate adjacent the entrance to the fireplace will facilitate adjustment of the remotely located damper of this invention while the fire is burning to effect the economies of fuel and heat as described above.

A sealing grommet 32 may be fitted around the upper edges of damper 21 to provide an effective seal with the inner surface of cover 15.

When it is desired to build a fire in the fireplace the chain 25 is moved to pin 27, 28 or 29, as desired, depending upon the size of opening desired for exhaust of the smoke and fumes from the fire. The depending flange 16 protects the flue liner from entry of driving rain and snow when the inner sleeve is lowered into operating position. When the inner sleeve 21 is raised to inoperative position the openings 20 are closed thereby preventing entry into the flue of any animals, birds, bats or leaves.

There is thus provided an efficient and economical combination chimney cover and damper which is easily installed and which is effective to cover the chimney in all kinds of weather, and to prevent loss of heat.

In the specification and drawings there has been described a preferred embodiment of the invention and although specific terms are employed they are used in a descriptive and generic sense only and not for purposes of limitation.

I claim:

1. A cover and damper for a chimney, said cover and damper comprising (a) an elongated sleeve having an open end and a closed end, (b) support means extending laterally from the sleeve in spaced relation to the open end of the sleeve and engagable with the top of the chimney to support the sleeve on the chimney with the open end inside the chimney and said closed end above the chimney, said closed end extending across the chimney and defining a stationary cover for the chimney;

(c) the portion of the sleeve between the support means and the closed end of the sleeve having at least one aperture therein establishing communication between the atmosphere and the interior of the sleeve, (d) a damper slidably mounted within the sleeve, and (e) means for varying the position of the damper relative to the aperture in the sleeve to selectively open and close the aperture.

2. A cover and damper according to claim 1 wherein said damper comprises an inner sleeve having a cross-sectional configuration corresponding to the cross-sectional configuration of said elongated sleeve and dimensioned to fit within said elongated sleeve with the axial dimension of the damper being at least as great as the vertical dimension of the opening in the exposed portion of the sleeve betweeen the support means and the closed end of the sleeve.

3. A cover and damper according to claim 2 wherein the damper is normally resiliently urged into engagement with the inner surface of the closed end of the sleeve to close the aperture.

4. A cover and damper according to claim 3 wherein the means for varying the position of the damper relative to the aperture in the elongated sleeve comprises a chain connected at one end to the damper and extending therefrom through the chimney to a point where it can be manually manipulated to move the damper.

5. A cover and damper according to claim 4 wherein an adjusting plate is provided adjacent the lower end of the chimney, means securing the adjusting plate at a convenient location near the lower end of the chimney, a plurality of generally vertically arranged pins extending laterally from said adjusting plate for selective reception of said chain, whereby the damper is retained in a desired position relative to the aperture in the sleeve.

6. A cover and damper according to claim 1 wherein the chimney cover coincides with the closed end of the sleeve and the chimney cover extends laterally from the sleeve in all directions.

7. A cover and damper according to claim 6 wherein a depending flange extends peripherally around the chimney cover.

8. A cover and damper according to claim 7 wherein said flange has a vertical dimension sufficient to at least partially overlap the aperture in the sleeve.

* * * * *